US006917263B2

(12) United States Patent
Abe et al.

(10) Patent No.: US 6,917,263 B2
(45) Date of Patent: Jul. 12, 2005

(54) HIGH-FREQUENCY WAVEGUIDE WITH COLUMNAR BODIES AND REFLECTING WALLS AND METHOD OF MANUFACTURING THE WAVEGUIDE

(75) Inventors: Shinji Abe, Tokyo (JP); Yoshihiro Kokubo, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 79 days.

(21) Appl. No.: 10/067,286

(22) Filed: Feb. 7, 2002

(65) Prior Publication Data

US 2003/0038690 A1 Feb. 27, 2003

(30) Foreign Application Priority Data

Aug. 23, 2001 (JP) ..... 2001-253537

(51) Int. Cl.[7] ..... H01P 3/18
(52) U.S. Cl. ..... 333/239; 333/248
(58) Field of Search ..... 333/239, 248

(56) References Cited

U.S. PATENT DOCUMENTS 5,389,943 A * 2/1995 Brommer et al. ..... 333/202 X
6,104,264 A * 8/2000 Ishikawa et al. ..... 333/248

FOREIGN PATENT DOCUMENTS

JP 11-218627 8/1999
JP 2000-352631 12/2000

OTHER PUBLICATIONS

Yoneyama, T. et al.; Nonradiative Dielectric Waveguide for Millimeter–Wave Integrated Circuits, *IEEE Transactions on Microwave Theory and Techniques*, vol. MTT–29, No. 11, pp. 1188–1192 (Nov. 1981).

Yoneyama, T. et al.; "Loss Measurements of Nonradiative Dielectric Waveguide", *IEEE Transactions on Microwave Theory and Techniques*, vol. MTT–32, No. 8, pp. 943–946 (Aug. 1984).

Joannopoulos, J.D. et al.; "Photonic crystals: putting a new twist on light", *Nature*, vol. 386, pp. 143–149 (Mar. 13, 1997).

Kokubo, Y. et al.; "Photonic crystal waveguides at millimeter and submillimeter wave", *IEICE Technical Report*, vol. 101, No. 100, pp. 23–29 (May 22, 2001).

* cited by examiner

*Primary Examiner*—Benny Lee
(74) *Attorney, Agent, or Firm*—Leydig, Voit & Mayer, Ltd.

(57) ABSTRACT

A first dielectric wall and a second dielectric wall in which hollow alumina cylindrical columns are arranged in layers so that axial centers of the alumina cylindrical columns describe planar triangular lattice arrays, are opposed to each other, and are parallel to air interposed between them. Metal plates are opposed to each other and have end faces of the alumina cylindrical columns interposed between and connected to the metal plates. The first and second dielectric walls and the metal plates are bonded to one another, as a high-frequency waveguide with reduced radiation loss, and that is inexpensive and low in transmission loss.

20 Claims, 5 Drawing Sheets

HIGH-FREQUENCY WAVEGUIDE WITH COLUMNAR BODIES AND REFLECTING WALLS AND METHOD OF MANUFACTURING THE WAVEGUIDE

BACKGROUND OF THE INVENTION

1. Field of the Invention

The present invention relates to a high-frequency waveguide and a method of manufacturing it, and particularly to a waveguide through which electromagnetic waves lying in a microwave band, a millimeter-wave band and a submillimeter-wave band propagate, and a manufacturing method thereof.

2. Description of the Related Art

As a waveguide for allowing electromagnetic waves (hereinafter called "high-frequency waves") lying in microwave, millimeter-wave, and submillimeter wave bands to propagate, a hybrid waveguide comprising a combination of wave guides, metals and a dielectric have been used. An NRD (nonradiative dielectric) guide with a dielectric interposed between two metal plates has been used as a waveguide in which metals and a dielectric are utilized in combination. As the known references, there are IEEE TRANSACTIONS ON MICROWAVE THEORY AND TECHNIQUES, VOL. MTT-29, NO. 11, NOVEMBER 1981, PP. 1188–1192, and IEEE TRANSACTIONS ON MICROWAVE THEORY AND TECHNIQUES, VOL. MTT-32, NO. 8, AUGUST 1984, PP. 943–946.

While the NRD guide has the feature that no radiation loss is produced at a bent portion of a waveguide, propagation loss increases because it is used in the neighborhood of a cutoff frequency of the waveguide. In addition to this, a waveguide using a photonic band crystal structure has been placed under study as a waveguide low in radiation loss.

The photonic band crystal structure includes an artificial crystal having a dielectric periodic structure having a high dielectric constant ratio and allows the occurrence of such an event that the propagation of energy is prohibited, at a given energy region, in the same manner as the case where the crystal controls electrons. The formation of a periodic-structure disturbing portion at part of the photonic band crystal structure makes it possible to cause energy to propagate through such a defective portion alone, whereby it can be formed as an energy propagation path.

As the known reference wherein the photonic band crystal structure is formed as a waveguide for optical transmission, there is known NATURE, VOL. 386, 13 Mar. 1997.

Further, Japanese Patent Application Laid Open No. 2000-352631 describes photonic crystals and a method of manufacturing the same. This shows one wherein cylindrical dielectrics arranged in a triangular lattice form to increase a mechanical strength are utilized in combination with perfect band gaps comprising dielectrics two-dimensionally arranged in a honeycomb lattice form as photonic crystals used in the field of the optical transmission.

Furthermore, Japanese Patent Application Laid-Open No. Hei 11(1999)-218627 describes a photonic crystal waveguide and a method of manufacturing it. This shows one formed with a slab optical waveguide formed of quartz glass or a polymeric material on a silicon substrate as a photonic crystal waveguide used in the field of optical communications. The slab optical waveguide is one wherein materials different in refractive index are arranged on both sides of a centrally-provided optical waveguide area in the form of a triangular lattice or a hexagonal lattice to provide refractive index variation areas. However, these photonic crystal waveguides are techniques related to optical waveguiding.

FIG. 7 is a perspective view of a conventional high-frequency waveguide based on a photonic band structure.

In FIG. 7, reference numeral 100 indicates a high-frequency waveguide, reference numeral 102 indicates a dielectric such as ceramic, and reference numerals 104 respectively indicate air columns whose arrangements in this air constitute a photonic band crystal structure. Reference numerals 106 indicate metal plates bonded to each other at both end faces of the dielectric 102 as viewed in the direction orthogonal to the air columns 104. In FIG. 7, the metal plates 106 are hatched as being not intended to indicate their sections but indented to clearly define a relationship of position between the two metal plates 106 and the dielectric 102.

FIG. 8 is a cross-sectional view of the high-frequency waveguide 100 as viewed from a section thereof taken along line VIII—VIII of FIG. 7. The section taken along line VIII—VIII corresponds to a section orthogonal to each of the air columns 104.

In FIG. 8, reference numerals 108 indicate high-frequency reflecting areas, and reference numeral 110 indicates a high-frequency propagation area.

When a high-frequency wave propagates through the high-frequency waveguide 100, each of the high-frequency reflecting areas 108 prohibits the propagation of a high-frequency wave corresponding to the photonic band crystal structure. However, since the high-frequency propagation area 110 has no air columns 104 and results in a defect of the photonic band crystal structure, the high-frequency wave can propagate through this portion.

When an electromagnetic wave propagates through the high-frequency propagation area 110, a high-frequency current flows due to an omnidirectional magnetic field as viewed in the tangential direction of each metal plate 106. This results in transmission loss of Joule's heat. However, since the transmission loss decreases with an increase in frequency in a mode in which the magnetic field principally has a high-frequency transmission direction of the high-frequency propagation area 110, it normally presents no problem.

However, since the high-frequency propagation area 110 makes use of a dielectric high in dielectric constant, a dielectric loss increases significantly.

FIG. 9 is a perspective view of a conventional high-frequency waveguide based on another photonic band structure. The same reference numerals as those shown in FIGS. 7 and 8 respectively indicate the same or equivalent ones. Even in the case of the description of the following drawings, the same reference numerals respectively indicate the same or equivalent ones.

Reference numeral 112 indicates a high-frequency waveguide, and reference numerals 114 and 116 respectively indicate dielectrics such as ceramic.

FIG. 10 is a partly sectional view of the high-frequency waveguide 112 as viewed from a section thereof taken along line X—X of FIG. 9, and FIG. 11 is a cross-sectional view of the high-frequency waveguide 112 as viewed from a section thereof taken along XI—XI of FIG. 9, respectively.

In the high-frequency waveguide 112 of FIGS. 10 and 11, high-frequency reflecting areas 108 are disposed in parts as two independent portions in which air columns 104 are regularly arranged in the dielectrics 114 and 116. A high-frequency propagation area 110 is defined as space filled with air. Therefore, a dielectric loss at this portion can be reduced.

However, in either case of the high-frequency waveguide 100 of FIGS. 7 and 8 and the high-frequency waveguide 112 of FIGS. 10 and 11, it is difficult to carry out the work of forming the desired air columns 110 in the dielectrics. Since the high-frequency propagation area 110 is defined in the space in the high-frequency waveguide 112, it is difficult to carry out dielectric-removing processing. This is not suited to mass production.

On the other hand, the paper Vol. J84-C No. 4 pp. 324–325, April 2001 issued by the Institute of Electronics, Information and Communication Engineers has described a photonic crystal waveguide wherein columnar bars in which alumina is covered with styrofoam, are provided in a triangular lattice array. However, this will cause an increase in loss.

SUMMARY OF THE INVENTION

The present invention has been made to overcome the above-described drawbacks and disadvantages of the related art. It is an object of the present invention to provide a high-frequency waveguide which is low in loss, simple in structure and low in cost.

According to one aspect of the invention, there is provided a high-frequency waveguide according to the present invention comprising: a first high-frequency reflecting wall including dielectric bars having respective lengths, each dielectric bar comprising a plurality of columnar bodies having respective axes and concentrically varying dielectric constants so that the dielectric constant on the respective axes is lower than the dielectric constant spaced from the respective axes, the dielectric bars of the first high-frequency reflecting wall being disposed in plural layers so that respective axes of the dielectric bars of the first high-frequency reflecting wall describe corners of a regular polygon lying in a plane perpendicular to the axes of the dielectric bars of the first high-frequency reflecting wall; a second high-frequency reflecting wall opposite, spaced from, and parallel to the first high-frequency reflecting wall, with a dielectric interposed between the first and second high-frequency reflecting walls, the second high-frequency reflecting wall including dielectric bars having respective lengths, each dielectric bar of the second high-frequency reflecting wall comprising a plurality of columnar bodies having respective axes and concentrically varying dielectric constants so that the dielectric constant on the respective axes is lower than the dielectric constant spaced from the respective axes, the dielectric bars of the second high-frequency reflecting wall being disposed in plural layers so that respective axes of the dielectric bars of the second high-frequency reflecting wall describe corners of a regular polygon in a plane perpendicular to the respective axes of the dielectric bars of the second high-frequency reflecting wall; and conductive plates which are opposite each other, with the first and second high-frequency reflecting walls interposed between the conductive plates and end faces of the dielectric bars of the first and second high-frequency reflecting walls connected to the conductive plates.

Accordingly, the dielectric bars constitute a photonic crystal structure, and the first and second high-frequency reflecting walls reflect all of high-frequency waves lying in a predetermined frequency band, the high-frequency waves having electric field components orthogonal to the axial directions of the dielectric bars, whereby a high-frequency waveguide is produced and has reduced radiation loss and low transmisison loss. A high-frequency waveguide low in transmisison loss and inexpensive can be manufactured with a simple structure.

It is another object of the present invention to provide a method of manufacturing a high-frequency waveguide low in loss and simple in structure in a simple process.

According to another aspect of the invention, there is provided a method of manufacturing a high-frequency waveguide, including laminating dielectric bars having respective lengths, each dielectric bar comprising a plurality of columnar bodies having respective axes and concentrically varying dielectric constants so that the dielectric constant is lower on the respective axes than spaced from the respective axes, in plural layers so that the respective axes of the dielectric bars describe corners of a regular polygon in a plane perpendicular to the respective axes thereby forming first and second high-frequency reflecting walls; and placing the first and second high-frequency reflecting walls opposite each other, parallel to each other, and spaced from each other, placing conductive plates opposite each other, with the first and second high-frequency reflecting walls interposed between the conductive plates, and connecting the conductive plates to respective end faces of the dielectric bars.

Accordingly, a high-frequency waveguide reduced in radiation loss and low in transmission loss can be manufactured in a simple process. The high-frequency waveguide, which has a good transmission characteristic, can be provided at low cost.

Other objects and advantages of the invention will become apparent from the detailed description given hereinafter. It should be understood, however, that the detailed description and specific embodiments are given by way of illustration only since various changes and modifications within the scope of the invention will become apparent to those skilled in the art from this detailed description.

BRIEF DESCRIPTION OF THE DRAWINGS

In all figures, substantially the same elements are given the same reference numbers. To avoid unnecessary repetition, each element of each structure is not described in detail for each figure.

DESCRIPTION OF THE PREFERRED EMBODIMENTS

First Embodiment

Figure 1:
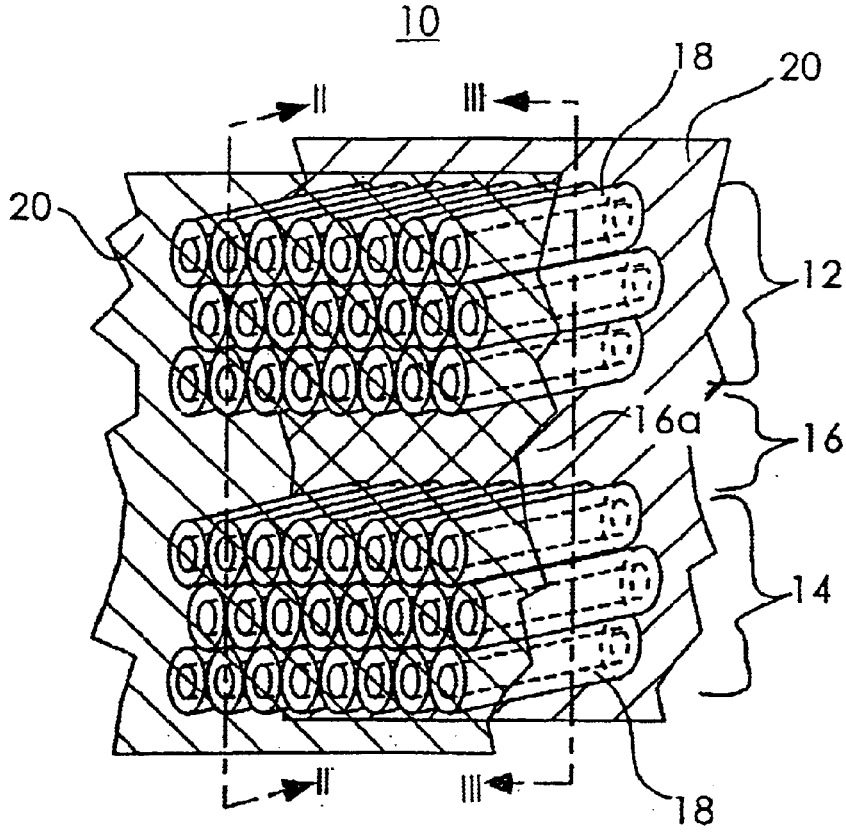
FIG. 1 is a partially-through partly perspective view of a high-frequency waveguide according to an embodiment of the present invention.
Figure 2:
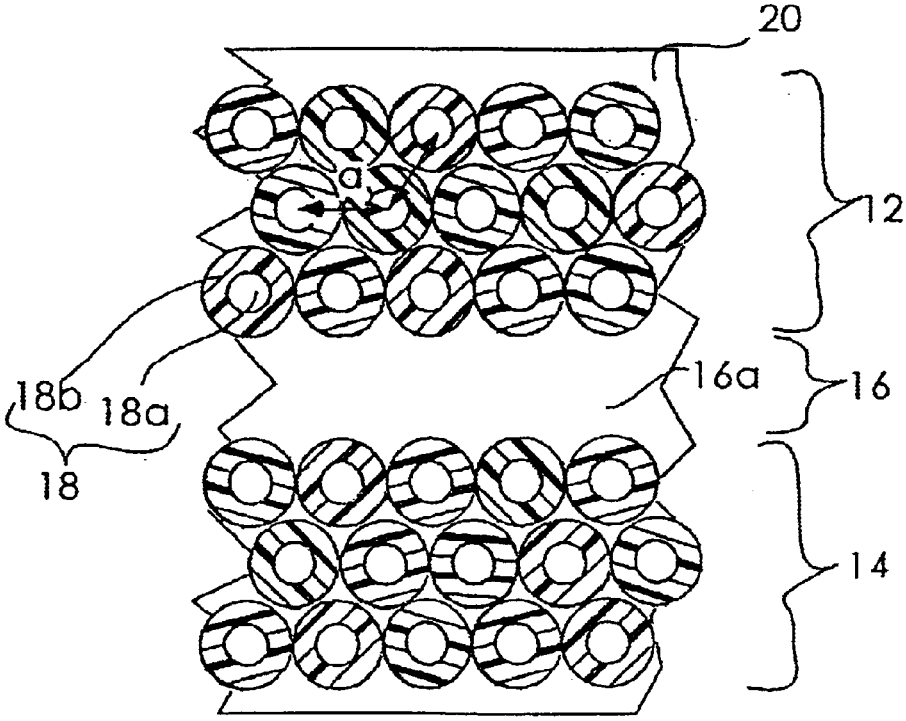
FIG. 2 is a partly sectional view of the high-frequency waveguide according to an embodiment of the present invention as viewed from a section thereof taken along line II—II of FIG. 1.
Figure 3:
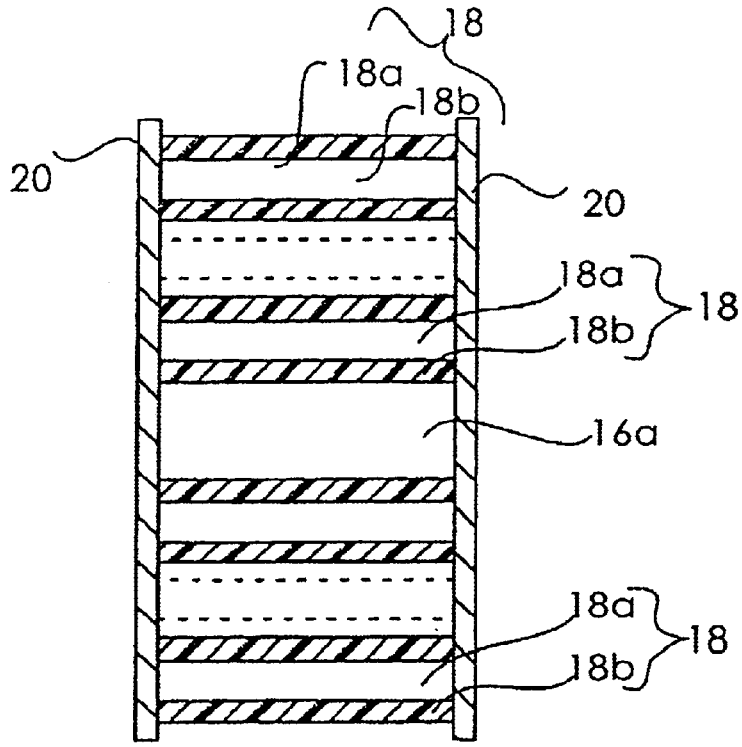
FIG. 3 is a sectional view of the high-frequency waveguide according to an embodiment of the present invention as viewed from a section thereof taken along line III—III of FIG. 1.

FIG. 1 is a partially-through partly perspective view of a high-frequency waveguide according to a first embodiment of the present invention. FIG. 2 is a partly sectional view of the high-frequency waveguide as viewed from a section thereof taken along line II—II of FIG. 1, and FIG. 3 is a sectional view of the high-frequency waveguide as viewed from a section thereof taken along line III—III of FIG. 1.

In FIG. 1, reference numeral 10 indicates a high-frequency waveguide, which is a waveguide using a photonic band crystal structure. This is a waveguide for allowing electromagnetic waves lying in micro-wave, millimeter-wave and submillimeter-wave bands to propagate therethrough. Reference numeral 12 indicates a first dielectric wall used as a first high-frequency reflecting wall, and reference numeral 14 indicates a second dielectric wall used as a second high-frequency reflecting wall. The first dielectric wall 12 and the second dielectric wall 14 constitute the photonic band crystal structure.

Reference numeral 16 indicates a high-frequency propagation area interposed between the first dielectric wall 12 and the second dielectric wall 14 disposed in parallel with a predetermined interval defined therebetween. In the present embodiment, the high-frequency propagation area 16 is a simple space and filled with air 16*a* used as a dielectric. However, it may not always be the air 16*a*. If a material low in dielectric constant is used, then a high-frequency wave can be propagated with a low loss.

Reference numerals 18 indicate alumina cylindrical columns or columns used as dielectric bars corresponding to fundamental elements which constitute the first dielectric wall 12 and the second dielectric wall 14. In the present embodiment, each of the alumina cylindrical columns 18 comprises an air column 18*a* defined as its center and an alumina cylinder 18*b* which surrounds the outside thereof. A cylindrical column made up of a material lower than the alumina cylinder 18*b* in dielectric constant may be provided on the central side as an alternative to the air column 18*a*. Namely, a layer structure comprising a plurality of layers may be adopted wherein the outsides of central-side columns low in dielectric constant are concentrically surrounded with cylinders each formed of a material high in dielectric constant. Alternatively, a columnar body having another sectional shape, which is not always cylindrical, may be adopted.

In order to constitute the photonic band crystal structure by using the alumina cylindrical columns 18, the first dielectric wall 12 and the second dielectric wall 14 are arranged in a three-layer form so that the axial centers or cores of the alumina cylindrical columns 18 constitute triangular lattice arrays respectively. As lattice intervals of the alumina cylindrical columns 18, a suitable value is determined according to the frequency of a high-frequency wave to be propagated. The lattice arrays do not necessarily require the triangular lattice arrays. Other lattice arrays such as a hexagonal lattice array, etc. may be used. The number of layers does not necessarily require the three. Further, the number of layers may be increased.

Reference numerals 20 indicate metal plates used as conductive or conductor plates, which are opposite to each other with the first dielectric wall 12 and the second dielectric wall 14 interposed therebetween. Further, the metal plates 20 are respectively bonded to the first dielectric wall 12 and the second dielectric wall 14 at both ends of the alumina cylindrical columns 18 which constitute the first dielectric wall 12 and the second dielectric wall 14. In FIG. 1, the metal plates 20 are hatched as being not intended to indicate their sections but indented to clearly define a relationship of position between the two metal plates 20 and the first and second dielectric walls 12 and 14. This is similar even in FIG. 4 to be described later.

Referring to FIG. 2, the distances indicated along the lines ending in arrows indicate respective lattice intervals.

A summary of a method of manufacturing a high-frequency waveguide 10 will next be described.

Hollow alumina cylindrical columns 18 each having the same diameter as each of the lattice intervals a of a photonic band crystal structure, which corresponds to the wavelength of a high-frequency wave, and having a height equivalent to a predetermined interval between the metal plate 20 are prepared. The cores of the alumina cylindrical columns 18 are arranged in shapes extending along the planar shape of each metal plate 20 of the high-frequency waveguide 10. An alumina cylindrical column array corresponding to a first layer is disposed in such a manner that the outer peripheries of the alumina cylindrical columns 18 are kept in close proximity to one another and both ends thereof are held in alignment with one another.

Next, when alumina cylindrical columns 18 used for or corresponding to a second layer are arranged so that they respectively make contact with the respective adjacent two alumina cylindrical columns 18 constituting the alumina cylindrical column array corresponding to the first layer at their outer peripheries together, the alumina cylindrical columns constituting the alumina cylindrical column array corresponding to the second layer also contact with one another. The two layers constitute at least a triangular lattice array.

Further, alumina cylindrical columns 18 corresponding to a third layer are arranged so that they respectively make contact with the respective adjacent two alumina cylindrical columns 18 constituting the alumina cylindrical column array corresponding to the second layer at their outer peripheries together, whereby alumina cylindrical column array corresponding to the third layer is formed. The alumina cylindrical column arrays corresponding to the first, second and third layers are bonded to one another with an adhesive. As a result, a first dielectric wall 12 is formed.

Next, a second dielectric wall 14 is formed according to a method similar to the above. A predetermined interval is defined between the first dielectric wall 12 and the second dielectric wall 14. Cylindrical end faces of alumina cylindrical columns 18 constituting the dielectric wall are disposed so as to make contact with the metal plate 20. The metal plate 20, the first dielectric wall 12 and the second dielectric wall 14 are bonded to one another. Further, another metal plate 20 is opposed to the metal plate 20 with the first dielectric wall 12 and the second dielectric wall 14 interposed therebetween. Another metal plate 20 is also bonded to the first dielectric wall 12 and the second dielectric wall 14.

As to another manufacturing method, a high-frequency propagation area 16 is formed of a material like, for example, styrofoam low in dielectric constant. Hollow alumina cylindrical columns 18 prepared so as to contact both sides of the high-frequency propagation area 16 are arranged so that their outer peripheries are held in contact with one another, whereby an alumina cylindrical column array corresponding to a first layer is arranged.

Next, alumina cylindrical columns 18 used for or corresponding to a second layer are respectively arranged so as to contact the adjacent two alumina cylindrical columns 18 constituting the alumina cylindrical column array corresponding to the first layer at their outer peripheries together. Consequently, the alumina cylindrical columns constituting the alumina cylindrical column array corresponding to the second layer also result in an array of columns which are held in contact with one another, whereby a triangular lattice array is formed.

Further, alumina cylindrical columns 18 for a third layer are arranged so as to make contact with the adjacent two alumina cylindrical columns 18 constituting the alumina cylindrical column array corresponding to the second layer, whereby an alumina cylindrical column array corresponding to the third layer is formed.

Thus, the first dielectric wall 12 and the second dielectric wall 14 are formed along the high-frequency propagation area 16. The high-frequency propagation area 16, the first dielectric wall 12, and the second dielectric wall 14 are shaped so as to take a predetermined waveguide shape and are fixedly secured to one another with an adhesive. Further, two more metal plates 20 are opposed to each other with the first dielectric wall 12 and the second dielectric wall 14 interposed therebetween. The metal plates 20 are bonded to the first dielectric wall 12 and the second dielectric wall 14.

Namely, since the arrangements of the alumina cylindrical columns 18 are arrayed to configure the photonic band crystal structure, a method of manufacturing it is simple. Since the interval between crystal lattices of the photonic band crystal structure is on the order of millimeters (mm) in microwaves, millimeter waves, and sub-millimeter waves, there is no need to take advantage of a photoengraving technique and an etching technique as distinct from an optical photonic band crystal structure. Simply arranging the alumina cylindrical columns 18 periodically makes it possible to fabricate a photonic band crystal structure and easily manufacture a long-distance high-frequency waveguide which is several tens of centimeters or a few meters in long, for example, thereby allowing mass production.

The operation of the high-frequency waveguide 10 will next be described.

Horns are coupled to input/output portions of the high-frequency waveguide 10 so that a high-frequency wave is inputted and/or outputted.

The first dielectric wall 12 and the second dielectric wall 14 of the high-frequency waveguide 10 constitute the photonic band crystal structure wherein the hollow alumina cylindrical columns 18 are arranged in form of the triangular lattice arrays. Thus, each high-frequency wave lying within a frequency band corresponding to the photonic band crystal structure is prohibited from propagating in the first dielectric wall 12 and the second dielectric wall 14. Since, however, the photonic band crystal structure is equivalent to a defect corresponding to a disordered state in the high-frequency propagation area 16, an input high-frequency wave is propagated through the high-frequency propagation area 16.

Namely, plane electromagnetic waves having electric field components orthogonal to the axial directions of the alumina cylindrical columns 18 are all reflected with respect to the high-frequency waves in the high-frequency band corresponding to the photonic band crystal structure. Thus, the high-frequency electromagnetic waves propagate along the high-frequency propagation area 16. Since the high-frequency propagation area 16 is filled with a dielectric, like air, low in dielectric constant, transmission loss is low, even in a high-frequency band.

A conventionally-known waveguide in which dielectric bars include peripheries of cylindrical columns having a high dielectric constant surrounded by cylindrical columns having low dielectric constant, are arranged in a triangular lattice form, is compared with a waveguide, as shown in the first embodiment, which constitutes a photonic band crystal structure, with dielectric bars including peripheries of cylindrical columns having a low dielectric constant surrounded by cylindrical columns with a high dielectric constant, as constituent elements. In the conventional waveguide, a gap is open to an E field (having an orientation of electric field identical to the axial direction of each dielectric bar). In other words, a frequency band unintended for propagation exists. However, no gap is open to an H field (having an orientation orthogonal to the axial direction of each dielectric bar). Therefore, the transmission loss increases even if the conventional waveguide is a high-frequency waveguide.

On the other hand, in the waveguide described in the present embodiment, gaps are set up or open to the E and H fields. Further, in the high-frequency waveguide 10, gaps are open to the E and H fields at a given specific frequency corresponding to each of the lattice intervals of the photonic band crystal structure, and hence a high-frequency waveguide with less transmission loss can be provided.

In the high-frequency waveguide according to the first embodiment as described above, the first dielectric wall 12 and the second dielectric wall 14 are configured with the dielectric bars, like the hollow alumina cylindrical columns 18, as the basic elements. Further, the high-frequency propagation area 16 includes a material with a low dielectric constant. Therefore, a high-frequency waveguide is provided with reduced transmission loss, that can be mass produced in a simple process, and that provides low cost and satisfactory transmission efficiency.

Second Embodiment

Figure 4:
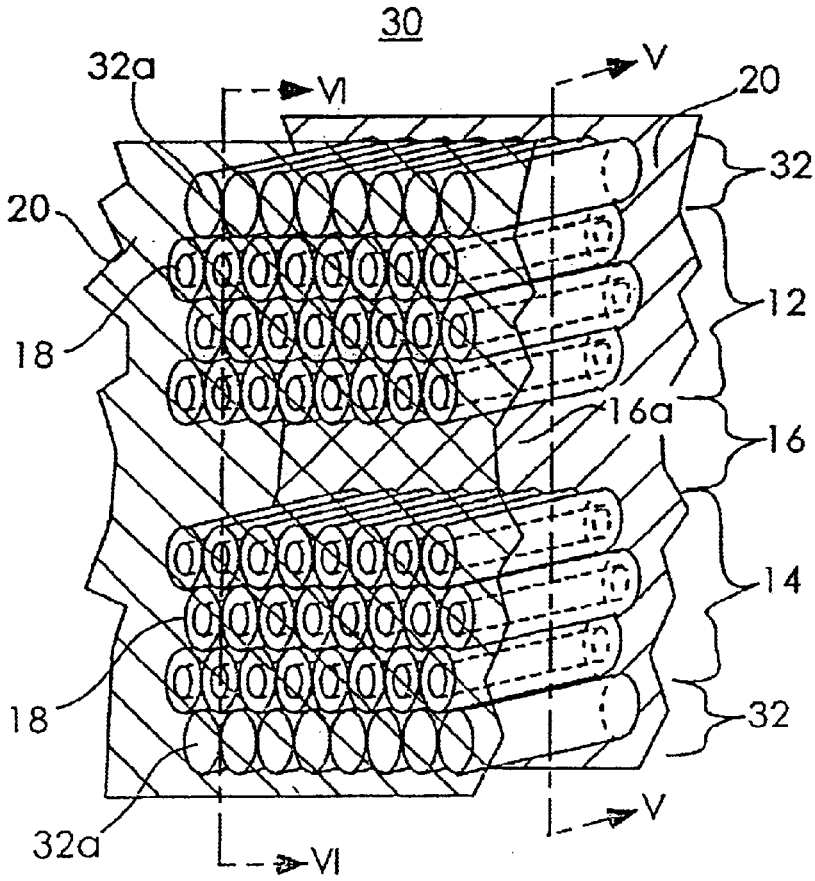
FIG. 4 is a partially-through partly perspective view of a high-frequency waveguide according to an embodiment of the present invention.
Figure 5:
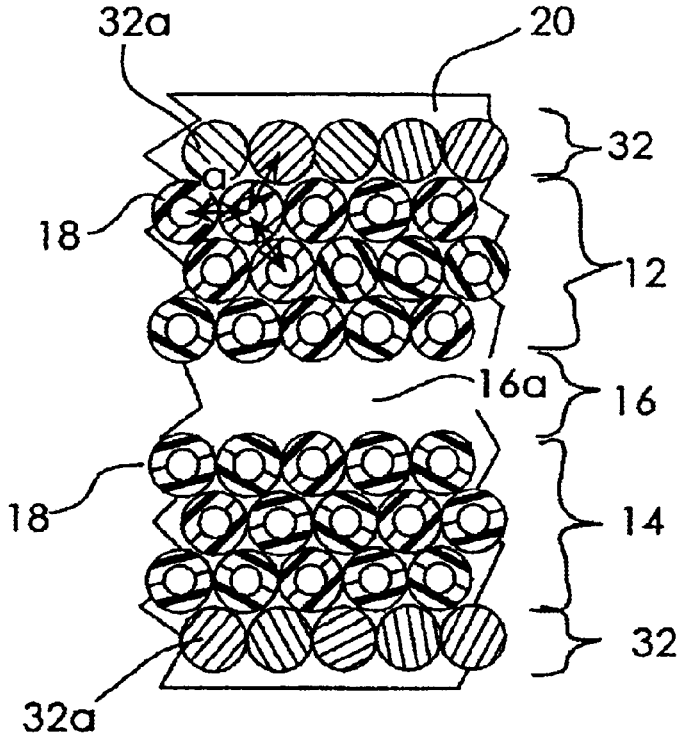
FIG. 5 is a partly sectional view of the high-frequency waveguide according to an embodiment of the present invention as viewed from a section thereof taken along line V—V of FIG. 4.
Figure 6:
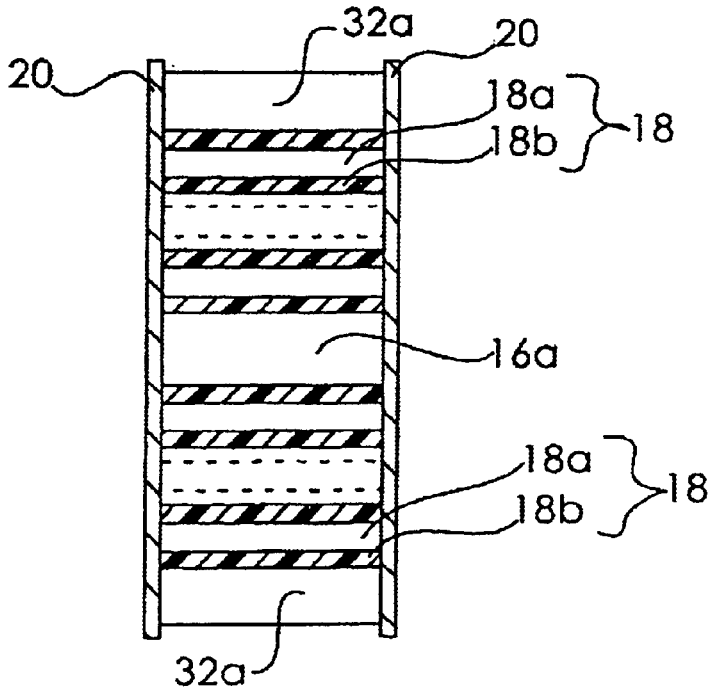
FIG. 6 is a sectional view of the high-frequency waveguide according to an embodiment of the present invention as viewed from a section thereof taken along line VI—VI of FIG. 4
Figure 7:
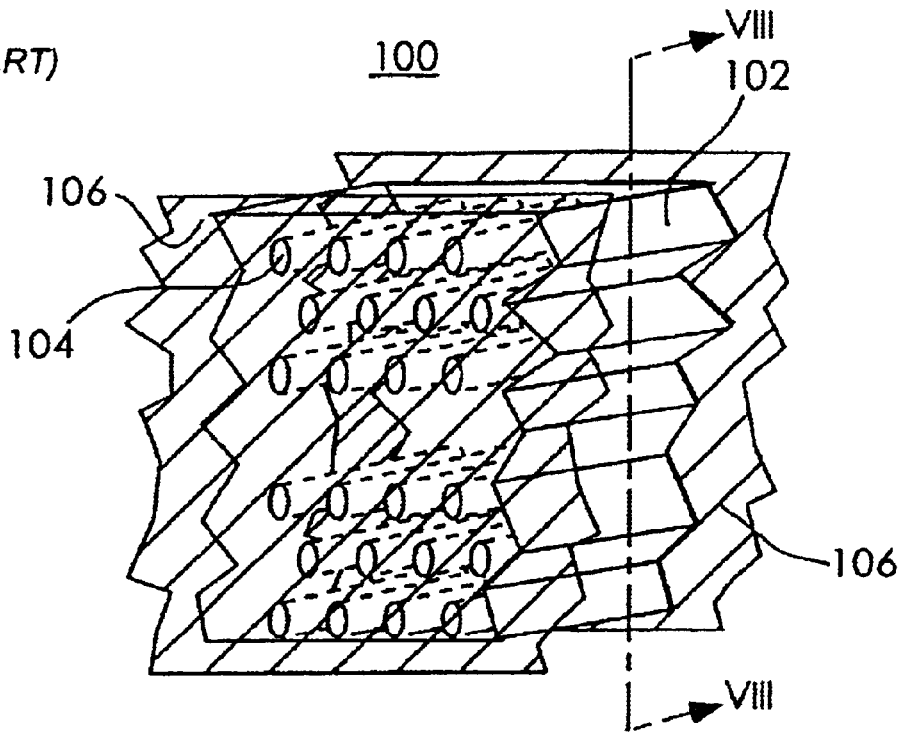
Fig.7 (PRIOR ART)
FIG. 7 is a perspective view of a conventional high-frequency waveguide.
Figure 8:
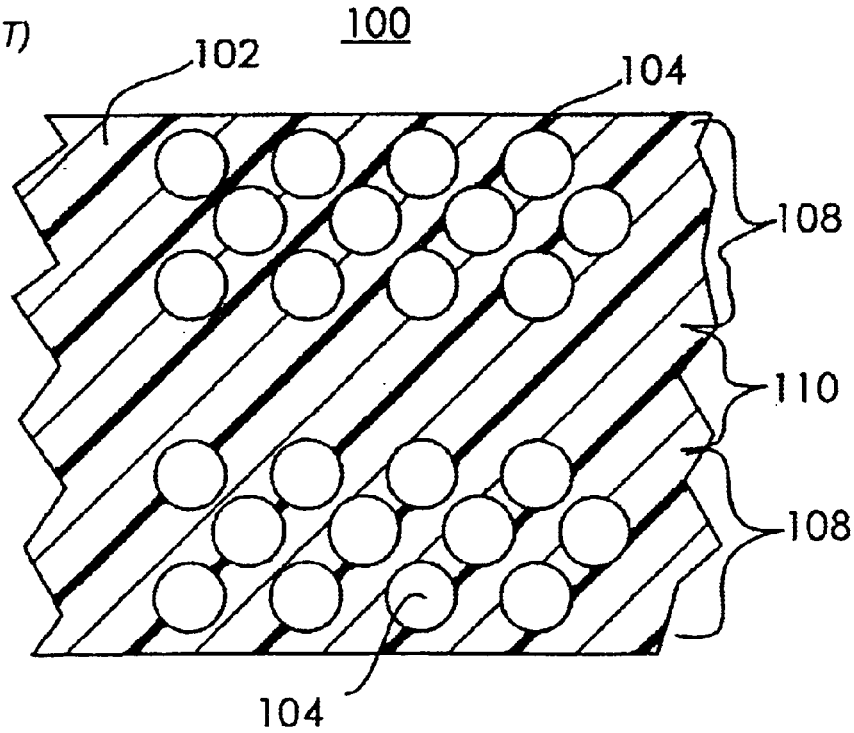
Fig.8 (PRIOR ART)
FIG. 8 is a cross-sectional view of a conventional high-frequency waveguide as viewed from a section thereof taken along line VIII—VIII of FIG. 7.
Figure 9:
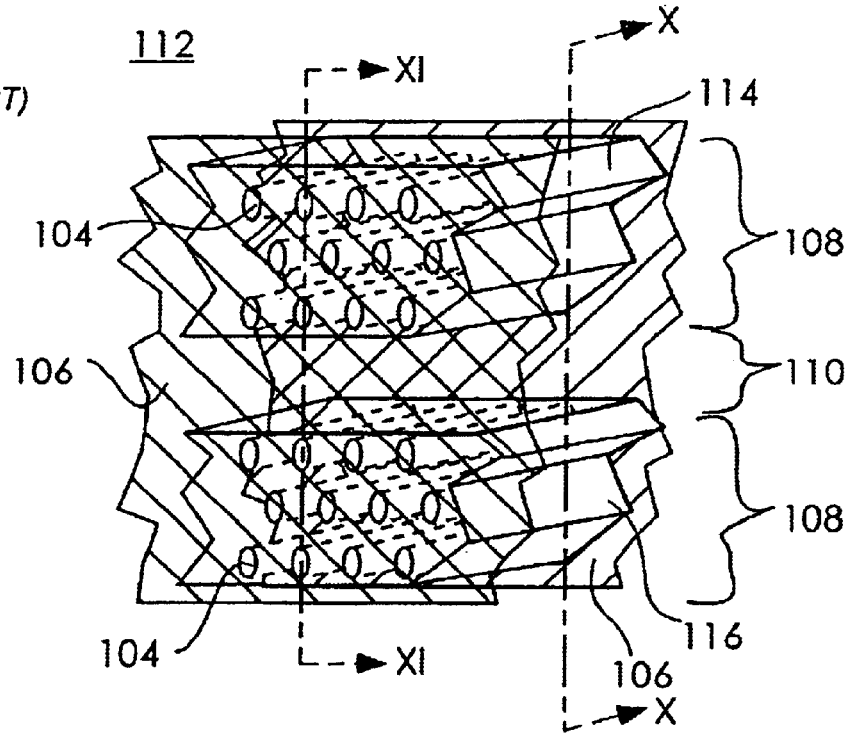
Fig.9 (PRIOR ART)
FIG. 9 is a perspective view of a conventional high-frequency waveguide.
Figure 10:
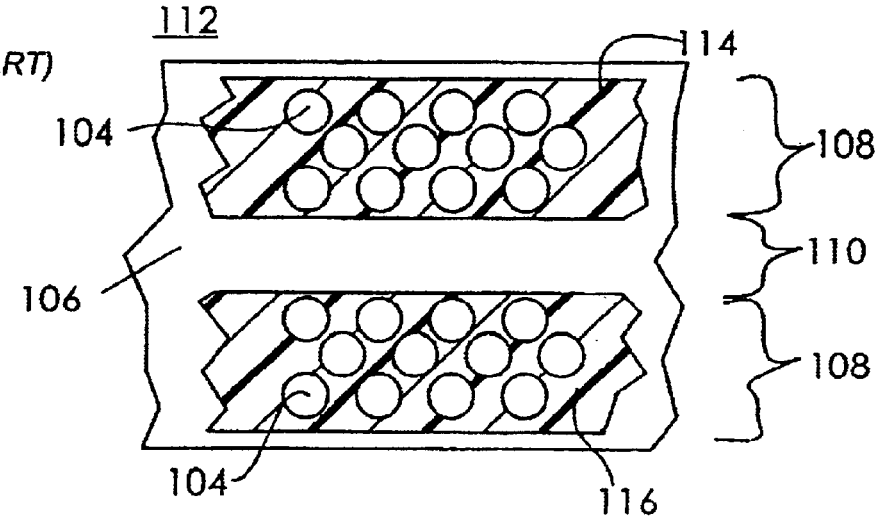
Fig.10 (PRIOR ART)
FIG. 10 is a partly sectional view of a conventional high-frequency waveguide as viewed from a section thereof taken along line X—X of FIG. 9.
Figure 11:
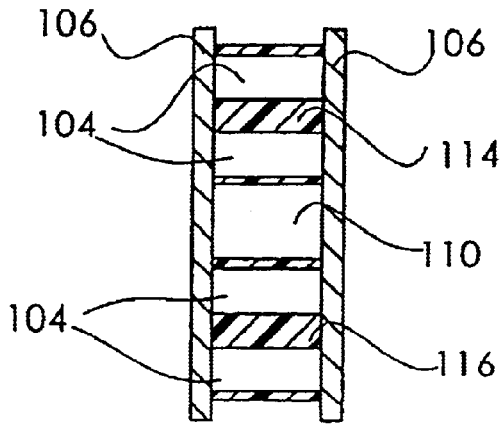
Fig.11 (PRIOR ART)
FIG. 11 is a cross-sectional view of a conventional high-frequency waveguide as viewed from a section thereof taken along XI—XI of FIG. 9.

FIG. 4 is a partially-through partly perspective view of a high-frequency waveguide according to a second embodiment of the present invention. FIG. 5 is a partly sectional view of the high-frequency waveguide as viewed from a section thereof taken along line V—V of FIG. 4, and FIG. 6 is a sectional view of the high-frequency waveguide as viewed from a section thereof taken along line VI—VI of FIG. 4.

In FIG. 4, reference numeral 30 indicates a high-frequency waveguide, reference numerals 32 indicate metal cylindrical column arrays used as metal walls respectively, and reference numerals 32*a* indicate metal cylindrical columns used as metal bars which constitute the metal cylindrical column arrays 32 respectively. The metal cylindrical column arrays 32 employed in the present embodiment are arranged outside a first dielectric wall 12 and a second dielectric wall 14 in such a manner that the metal cylindrical columns 32*a* identical in diameter and length to alumina cylindrical columns 18 take triangular lattice arrays together with the alumina cylindrical columns 18 corresponding to the outermost layers of the first dielectric wall 12 and the second dielectric wall 14.

A method of manufacturing the high-frequency waveguide 30 is basically identical to the method of manufacturing the high-frequency waveguide 10 according to the first embodiment. Upon forming each of the first dielectric wall 12 and the second dielectric wall 14, the metal cylindrical columns 32*a* may be provided as triangular lattice arrays together with the alumina cylindrical columns 18 corresponding to the outermost layers of the first and second dielectric walls 12 and 14.

The first dielectric wall 12 and second dielectric wall 14 provided on both sides of a high-frequency propagation area 16 prohibit the propagation of high-frequency waves lying within a frequency band corresponding to a photonic band crystal structure. Namely, plane electromagnetic waves having electric field components orthogonal to the axial directions of the alumina cylindrical columns 18 are all reflected with respect to the high-frequency waves in the frequency band corresponding to the photonic band crystal structure. There, the high-frequency electromagnetic waves propagate along the high-frequency propagation area 16.

However, each of the high-frequency waves that propagate through the high-frequency propagation area 16, has components parallel to the axial direction of each alumina cylindrical column 18 as well as the electric field components lying in the direction orthogonal to the axis direction of each alumina cylindrical column 18. The components parallel to the axial direction of each alumina cylindrical column 18 pass through the hollow alumina cylindrical columns 18.

The metal cylindrical columns 32*a* reflect all the high-frequency components that pass through the alumina cylindrical columns 18. At this time, a current flows through each metal cylindrical column array 32, which result in a conductor loss. However, since it decreases with an increase in frequency, this becomes insignificant so far in the case of a high frequency.

While the metal cylindrical column arrays 32 have been used as the metal walls in the second embodiment, metal column arrays each having a cross-section shaped in other form may be used or plate-shaped metal walls may be adopted.

Namely, the high-frequency waveguide according to the second embodiment is provided with the low-loss waveguide walls which reflect even the electric field components parallel to the axial directions of the alumina cylindrical columns 18 constituting the photonic band crystal structure as well as the electric field components lying in the direction orthogonal to the axial direction of each of the alumina cylindrical columns 18. Consequently, a waveguide can be configured which is free of the leakage of a high-frequency wave and low in loss. A high-frequency waveguide, which is low in cost and provides satisfactory transmission efficiency, can be constructed.

Since the high-frequency waveguide according to the present invention and the manufacturing method thereof have such configurations as described above and include the steps as well, the following advantageous effects are brought about.

The high-frequency waveguide according to the present invention comprises a first high-frequency reflecting wall including dielectric bars having respective lengths, each dielectric bar comprising a plurality of columnar bodies having respective axes and concentrically varying dielectric constants so that the dielectric constant on the respective axes is lower than the dielectric constant spaced from the respective axes, the dielectric bars of the first high-frequency reflecting wall being disposed in plural layers so that respective axes of the dielectric bars of the first high-frequency reflecting wall describe corners of a regular polygon lying in a plane perpendicular to the axes of the dielectric bars of the first high-frequency reflecting wall; a second high-frequency reflecting wall opposite, spaced from, and parallel to the first high-frequency reflecting wall, with a dielectric interposed between the first and second high-frequency reflecting walls, the second high-frequency reflecting wall including dielectric bars having respective lengths, each dielectric bar of the second high-frequency reflecting wall comprising a plurality of columnar bodies having respective axes and concentrically varying dielectric constants so that the dielectric constant on the respective axes is lower than the dielectric constant spaced from the respective axes, the dielectric bars of the second high-frequency reflecting wall being disposed in plural layers so that respective axes of the dielectric bars of the second high-frequency reflecting wall describe corners of a regular polygon in a plane perpendicular to the respective axes of the dielectric bars of the second high-frequency reflecting wall; and conductive plates which are opposite each other, with the first and second high-frequency reflecting walls interposed between the conductive plates and end faces of the dielectric bars of the first and second high-frequency reflecting walls connected to the conductive plates. The dielectric bars constitute a photonic crystal structure. The first and second high-frequency reflecting walls reflect all of high-frequency waves lying in a predetermined frequency band, the high frequency waves having electric field components orthogonal to the axial directions of the dielectric bars, whereby a high-frequency waveguide can be produced with reduced radiation loss and low transmission loss. A high-frequency waveguide low in transmission loss and inexpensive to manufacture can be produced with a simple structure.

Further, the dielectric bars are shaped in the form of cylinders. The shapes of the dielectric bars corresponding to the constituent elements of the first and second high-frequency reflecting walls can be simplified. A simpler and cheaper high-frequency waveguide can be provided.

Furthermore, the dielectric bars are shaped in hollow form. A material low in dielectric constant, on the axial center side of each dielectric bar is set up as air, so that the construction of the dielectric bar can be simplified. A low-cost high-frequency waveguide with a simple structure is provided.

Still further, since the dielectric lying between the first high-frequency reflecting wall and the second high-frequency reflecting wall is air, the transmission loss can be reduced with a simple structure. An inexpensive high-frequency waveguide low in transmission loss with a simple structure is provided.

Still further, metal walls are further provided outside the dielectric bars corresponding to the outermost layers of the first and second high-frequency reflecting walls. The metal walls are capable of reflecting high-frequency waves having electric field components parallel to the axial directions of the dielectric bars. A high-frequency waveguide with reduced leakage of the high-frequency waves and good in transmission efficiency is provided.

Still further, the metal walls are made up of metal bar arrays in which metal bars identical in length to dielectric bars are disposed along the dielectric bars. Each of the metal walls can be brought to a simple configuration easy to lay out along each dielectric bar. A high-frequency waveguide low in cost and good in transmission efficiency is provided.

A method of manufacturing a high-frequency waveguide, according to the present invention, includes laminating dielectric bars having respective lengths, each dielectric bar comprising a plurality of columnar bodies having respective axes and concentrically varying dielectric constants so that the dielectric constant is lower on the respective axes than spaced from the respective axes, in plural layers so that the respective axes of the dielectric bars describe corners of a regular polygon in a plane perpendicular to the respective axes, thereby forming first and second high-frequency reflecting walls; and placing the first and second high-frequency reflecting walls opposite each other, parallel to each other, and spaced from each other, placing conductive plates opposite each other, with the first and second high-frequency reflecting walls interposed between the conductive plates, and connecting the conductive plates to respective end faces of the dielectric bars. A high-frequency waveguide reduced in radiation loss and low in transmission loss can be manufactured in a simple process. A high-frequency waveguide good in transmission characteristic can be provided at low cost.

The method further includes forming metal walls outside the dielectric bars corresponding to the outermost layers of the first and second high-frequency reflecting walls. A high-frequency waveguide capable of reflecting each high-frequency wave having electric field components parallel to the axial directions of the dielectric bars can be manufactured in a simple process. A high-frequency waveguide reduced in leakage of the high-frequency wave and good in transmission characteristic can be provided at a low cost.

While the presently preferred embodiments of the present invention have been shown and described. It is to be understood these disclosures are for the purpose of illustration and that various changes and modifications may be made without departing from the scope of the invention as set forth in the appended claims.

What is claimed is:

1. A high-frequency waveguide comprising:

a first high-frequency reflecting wall including dielectric bars having respective lengths, each dielectric bar comprising a plurality of columnar bodies having respective axes and concentrically varying dielectric constants so that the dielectric constant on the respective axes is lower than the dielectric constant spaced from the respective axes, the dielectric bars of the first high-frequency reflecting wall being disposed in plural layers so that respective axes of the dielectric bars of the first high-frequency reflecting wall describe corners of a regular polygon lying in a plane perpendicular to the axes of the dielectric bars of the first high-frequency reflecting wall;

a second high-frequency reflecting wall opposite, spaced from, and parallel to the first high-frequency reflecting wall, with a dielectric interposed between the first and second high-frequency reflecting walls, the second high-frequency reflecting wall including dielectric bars having respective lengths, each dielectric bar of the second high-frequency reflecting wall comprising a plurality of columnar bodies having respective axes and concentrically varying dielectric constants so that the dielectric constant on the respective axes is lower than the dielectric constant spaced from the respective axes, the dielectric bars of the second high-frequency reflecting wall being disposed in plural layers so that respective axes of the dielectric bars of the second high-frequency reflecting wall describe corners of a regular polygon in a plane perpendicular to the respective axes of the dielectric bars of the second high-frequency reflecting wall; and conductive plates which are opposite each other, with the first and second high-frequency reflecting walls interposed between the conductive plates and end faces of the dielectric bars of the first and second high-frequency reflecting walls connected to the conductive plates.

2. The high-frequency waveguide according to claim 1, wherein the dielectric bars of the first and second high-frequency reflecting walls are cylindrical.

3. The high-frequency waveguide according to claim 2, wherein the dielectric bars of the first and second high-frequency reflecting walls are hollow.

4. The high-frequency waveguide according to claim 3, including metal walls located outside the dielectric bars of the first and second high-frequency reflecting walls and corresponding to outermost layers of the first and second high-frequency reflecting walls.

5. The high-frequency waveguide according to claim 4, wherein the metal walls respectively comprise metal bar arrays in which metal bars substantially identical in length to the dielectric bars of the first and second high-frequency reflecting walls are disposed along the dielectric bars of the first and second high-frequency reflecting walls.

6. The high-frequency waveguide according to claim 2, wherein the dielectric interposed between the first high-frequency reflecting wall and the second high-frequency reflecting wall is air.

7. The high-frequency waveguide according to claim 6, including metal walls located outside the dielectric bars of the first and second high-frequency reflecting walls and corresponding to outermost layers of the first and second high-frequency reflecting walls.

8. The high-frequency waveguide according to claim 7, wherein the metal walls respectively comprise metal bar arrays in which metal bars substantially identical in length to the dielectric bars of the first and second high-frequency reflecting walls are disposed along the dielectric bars of the first and second high-frequency reflecting walls.

9. The high-frequency waveguide according to claim 1, wherein the dielectric bars of the first and second high-frequency reflecting walls are hollow.

10. The high-frequency waveguide according to claim 9, including metal walls located outside the dielectric bars of the first and second high-frequency reflecting walls and corresponding to outermost layers of the first and second high-frequency reflecting walls.

11. The high-frequency waveguide according to claim 10, wherein the metal walls respectively comprise metal bar arrays in which metal bars substantially identical in length to the dielectric bars of the first and second high-frequency reflecting walls are disposed along the dielectric bars of the first and second high-frequency reflecting walls.

12. The high-frequency waveguide according to claim 1, including metal walls located outside the dielectric bars of the first and second high-frequency reflecting walls and corresponding to outermost layers of the first and second high-frequency reflecting walls.

13. The high-frequency waveguide according to claim 12, wherein the metal walls respectively comprise metal bar arrays in which metal bars substantially identical in length to the dielectric bars of the first and second high-frequency reflecting walls are disposed along the dielectric bars of the first and second high-frequency reflecting walls.

14. The high-frequency waveguide according to claim 2, including metal walls located outside the dielectric bars of the first and second high-frequency reflecting walls and corresponding to outermost layers of the first and second high-frequency reflecting walls.

15. The high-frequency waveguide according to claim 14, wherein the metal walls respectively comprise metal bar arrays in which metal bars substantially identical in length to the dielectric bars of the first and second high-frequency reflecting walls are disposed along the dielectric bars of the first and second high-frequency reflecting walls.

16. The high-frequency waveguide according to claim 1, wherein the dielectric interposed between the first high-frequency reflecting wall and the second high-frequency reflecting wall is air.

17. The high-frequency waveguide according to claim 16, including metal walls located outside the dielectric bars of the first and second high-frequency reflecting walls and corresponding to outermost layers of the first and second high-frequency reflecting walls.

18. The high-frequency waveguide according to claim 17, wherein the metal walls respectively comprise metal bar arrays in which metal bars substantially identical in length to the dielectric bars of the first and second high-frequency reflecting walls are disposed along the dielectric bars of the first and second high-frequency reflecting walls.

19. A method of manufacturing a high-frequency waveguide including:

laminating dielectric bars having respective lengths, each dielectric bar comprising a plurality of columnar bodies having respective axes and concentrically varying dielectric constants so that the dielectric constant is lower on the respective axes than spaced from the respective axes, in plural layers so that the respective axes of the dielectric bars describe corners of a regular polygon in a plane perpendicular to the respective axes, thereby forming first and second high-frequency reflecting walls; and placing the first and second high-frequency reflecting walls opposite each other, parallel to each other, and spaced from each other, placing conductive plates opposite each other, with the first and second high-frequency reflecting walls interposed between the conductive plates, and connecting the conductive plates to respective end faces of the dielectric bars.

20. The method according to claim 19, further including forming metal walls outside the dielectric bars corresponding to outermost layers of the first and second high-frequency reflecting walls.

* * * * *